US006553769B2

(12) United States Patent
Halila et al.

(10) Patent No.: US 6,553,769 B2
(45) Date of Patent: Apr. 29, 2003

(54) METHOD FOR PROVIDING CONCENTRICITY OF PILOT FUEL ASSEMBLY IN A COMBUSTOR

(75) Inventors: Ely E. Halila, Cincinnati, OH (US); Michael Anderson, Cincinnati, OH (US); James A. Martus, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/903,952

(22) Filed: Jul. 12, 2001

(65) Prior Publication Data

US 2002/0148230 A1 Oct. 17, 2002

Related U.S. Application Data

(62) Division of application No. 09/213,400, filed on Dec. 16, 1998, now abandoned.

(51) Int. Cl.[7] ..... F02C 7/22

(52) U.S. Cl. ..... 60/772; 60/798; 60/748; 60/39.826

(58) Field of Search ..... 60/772, 748, 740, 60/261, 796, 798, 800, 746, 747, 39.826

(56) References Cited

U.S. PATENT DOCUMENTS 3,159,971 A * 12/1964 Moebius et al. ..... 60/740
4,441,323 A * 4/1984 Colley ..... 60/748
4,466,240 A * 8/1984 Miller ..... 60/796
5,117,624 A * 6/1992 Roberts et al. ..... 60/796
5,305,609 A * 4/1994 Guinan et al. ..... 60/740
5,335,490 A * 8/1994 Johnson et al. ..... 60/740
5,396,761 A * 3/1995 Woltmann et al. ..... 60/749

* cited by examiner

*Primary Examiner*—Ted Kim
(74) *Attorney, Agent, or Firm*—William Scott Andes; Patrick R. Scanlon; Pierce Atwood

(57) ABSTRACT

Concentric installation of a pilot fuel assembly in an opening in a gas turbine combustor casing is achieved by providing a boss having at least two flat surfaces which are perpendicular to each other on the combustor casing surrounding the opening and a mounting flange having at least two flat surfaces which are perpendicular to each other on the pilot fuel assembly. The pilot fuel assembly is concentrically installed to the combustor casing by inserting the assembly into the combustor casing opening, and moving the pilot fuel assembly as far as it will go in a first direction substantially parallel to one of the flat boss surfaces. The distance between the other flat boss surface and one of the flat flange surfaces is then taken. Next, the pilot fuel assembly is moved in the direction opposite the first direction, at which point, the distance between the same two flat surfaces is again measured. Lastly, the pilot fuel assembly is located at a position where the distance between the two measuring surfaces is equal to the average of the first and second measurements. If desired, these steps can be repeated back and forth along an axis perpendicular to the first and second directions.

15 Claims, 7 Drawing Sheets

METHOD FOR PROVIDING CONCENTRICITY OF PILOT FUEL ASSEMBLY IN A COMBUSTOR

CROSS REFERENCE TO RELATED APPLICATIONS

This application is a division of application Ser. No. 09/213,400, filed Dec. 16, 1998, now abn.

STATEMENT REGARDING FEDERALLY SPONSORED RESEARCH & DEVELOPMENT

The U.S. Government may have certain rights in this invention pursuant to contract number NAS3-27235 awarded by NASA.

BACKGROUND OF THE INVENTION

This invention relates generally to combustors for gas turbine engines and more particularly to properly and repeatedly positioning all pilot fuel assemblies in such combustors.

A gas turbine engine includes a compressor that provides pressurized air to a combustor wherein the air is mixed with fuel and ignited in a combustion zone for generating high temperature gases. These gases flow downstream to one or more turbine stages that extract energy therefrom to power the compressor and provide useful work such as powering an aircraft in flight or land based engines. It is desirable to reduce exhaust emissions produced by the combustion process. This is particularly true for the new generation of supersonic transport, referred to as High Speed Civil Transport (HSCT), that is currently under development. For HSCT to be viable, emission levels, particularly $NO_X$, must be significantly reduced relative to present aircraft while maintaining high combustion efficiencies. Efforts to reduce emissions in the HSCT have led to the development of a combustor having a plurality of pilot fuel systems that direct a swirled mixture of fuel and air radially into the combustion zone.

Such pilot fuel systems typically include a pilot fuel assembly and a swirler assembly. A major assembly requirement for this type of pilot fuel system is to maintain concentricity between the pilot fuel assembly and its corresponding swirler assembly. Since the air exiting from the swirler assembly is swirling at a defined angular discharge, a static pressure imbalance can develop within the swirling chamber if the concentricity is not maintained. This results in local static pressure variations that can cause the fuel/air mixture to pre-ignite prior to its discharge into the combustion chamber. This is a potentially hazardous condition in locations where combustion is undesirable. However, because it is mounted from outside of the outer combustor casing, installation of the pilot fuel assembly is a blind process. Thus, concentricity between the pilot fuel assembly and the swirler assembly cannot be maintained or even determined. In addition, concentricity variations from one pilot fuel system to another will exist, resulting in nonconformance in minimizing pre-combustion. The problem is compounded by the dimensional stack-up for the various pilot fuel system components that results from the manufacturing tolerances.

Accordingly, there is a need for a repeatable method of providing concentricity for a pilot fuel system in a gas turbine combustor. There is also a need for a combustor having a pilot fuel system configured in such a manner that permits concentric installation and minimizes concentricity variations.

SUMMARY OF THE INVENTION

The above-mentioned needs are met by the present invention which provides a gas turbine combustor having a combustor casing with an opening formed therein and a boss formed thereon surrounding the opening. A pilot fuel assembly having a mounting flange is disposed in the opening, with the mounting flange being encircled by the boss. Both the boss and the mounting flange are provided with at least two flat surfaces that are perpendicular to each other. The pilot fuel assembly is concentrically installed to the combustor casing by inserting the assembly into the combustor casing opening, and moving the pilot fuel assembly as far as it will go in a first direction substantially parallel to one of the flat boss surfaces. The distance between the other flat boss surface and one of the flat flange surfaces is then taken. Next, the pilot fuel assembly is moved in the direction opposite the first direction, at which point, the distance between the same two flat surfaces is again measured. Lastly, the pilot fuel assembly is located at a position where the distance between the two measuring surfaces is equal to the average of the first and second measurements. If desired, these steps can be repeated back and forth along an axis perpendicular to the first and second directions.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
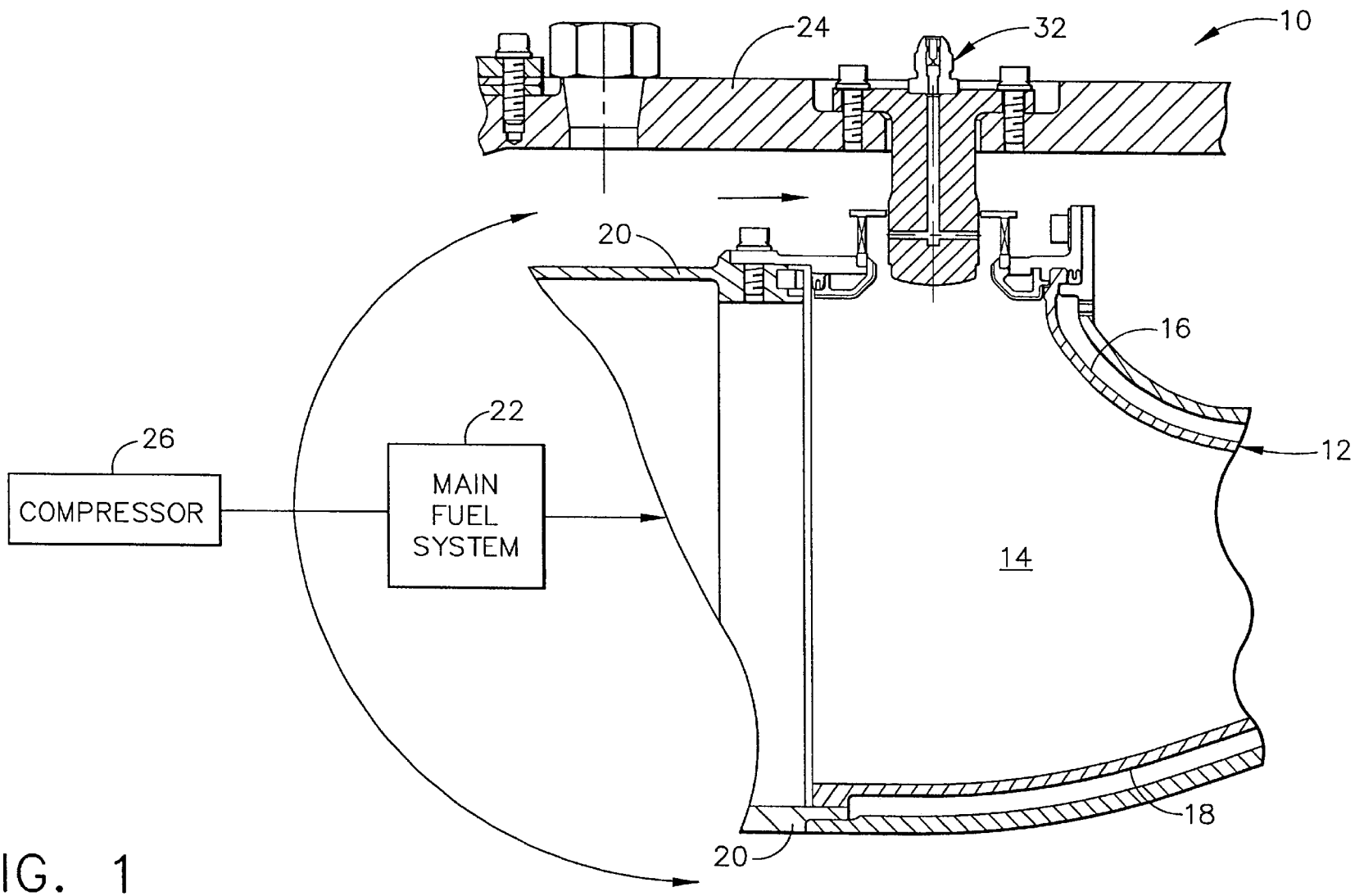
FIG. 1 is a sectional view of a combustor having a pilot fuel system that is concentrically installed in a gas turbine engine.

Referring to the drawings wherein identical reference numerals denote the same elements throughout the various views, FIG. 1 shows a low emissions combustor 10 of the type suitable for use in a gas turbine engine and including a hollow body 12 defining a combustion chamber 14 therein. Hollow body 12 is generally annular in form and is comprised of an outer liner 16 and an inner liner 18. A dome 20 is mounted to the upstream end of hollow body 12 and houses a main fuel system 22. Compressed air is supplied from a compressor 26. As shown schematically in FIG. 1, the compressed air branches into three main flows. The first portion goes to main fuel system 22, where it is mixed with fuel and then discharged into combustion chamber 14. A second portion is directed to an inner region of combustor 10 where it is used to cool inner liner 18 and turbomachinery further downstream. A third portion is directed to an outer region of combustor 10 where it is used to supply a pilot fuel system 32 described in more detail below and to cool outer liner 16 and turbomachinery further downstream. Hollow body 12 is enclosed by a suitable combustor casing 24.

A pilot fuel system 32 is mounted to casing 24, aft of dome 20. While only one pilot fuel system 32 is shown in FIG. 1 for clarity of illustration, it should be noted that a plurality of such pilot fuel systems 32 can be disposed circumferentially about combustor 10 at the same axial location slightly downstream of dome 20. The number of pilot fuel systems depends on the size of the combustor. Pilot fuel system 32 is directed radially inward so as to inject a swirled mixture of fuel and air radially into combustion chamber 14.

Figure 2:
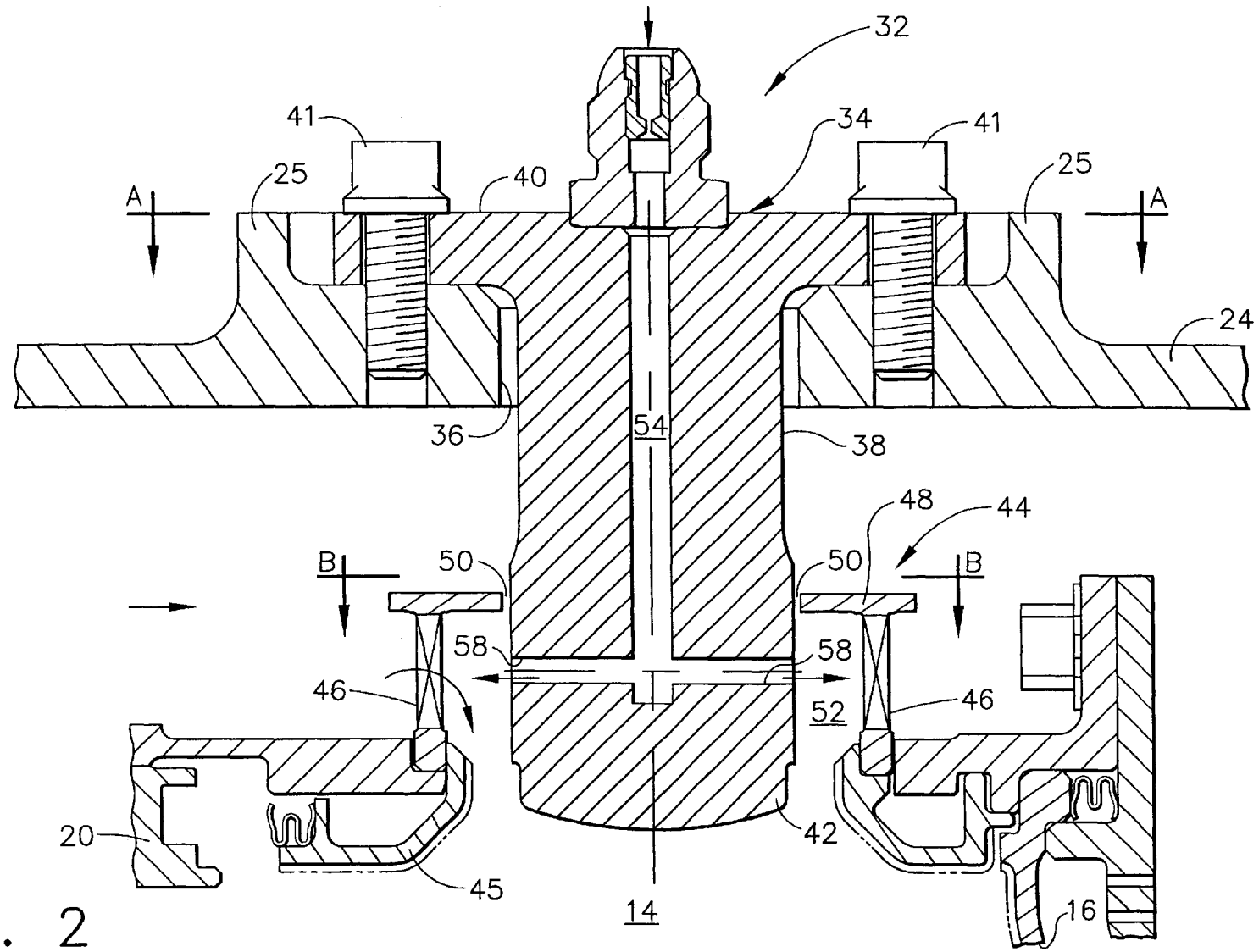
FIG. 2 is an enlarged sectional view of the pilot fuel system of FIG. 1.

As best seen in FIG. 2, pilot fuel system 32 includes a pilot fuel assembly 34 disposed in an opening 36 in casing 24. Pilot fuel assembly 34 includes a substantially cylindrical body 38 having a mounting flange 40 formed at one end thereof for fastening pilot fuel assembly 34 to casing 24 with bolts 41. Flange 40 is encircled by a boss 25 formed on casing 24 around opening 36. A heat shield 42 is formed on the other end of cylindrical body 38. Pilot fuel system 32 also includes a swirler assembly 44 that is mounted between outer liner 16 and dome 20. Pilot fuel assembly 34 is positioned in opening 36 so that cylindrical body 38 is located within swirler assembly 44. The space between swirler assembly 44 and cylindrical body 38 defines a tangential swirling chamber 52. Swirler assembly 44 includes a pilot outer liner 45 and a plurality of circumferentially-spaced swirl vanes 46 fixedly joined to a cap plate 48. Cap plate 48 has a circular aperture 50 formed therein for receiving cylindrical body 38. The purpose of cap plate 48 is to provide an enclosure for the swirling air that allows it to exit into combustion chamber 14. Pilot fuel assembly 34 includes a fuel passage 54 extending longitudinally through body 38 along its longitudinal axis through which fuel is delivered. The cylindrical body 38 also includes ports 58 in fluid communication with passage 54. Thus, fuel is injected into tangential swirling chamber 52, where it is mixed with the swirling air. This fuel/air mixture exits into combustion chamber 14 where it ignites and forms high temperature gases.

Figure 3:
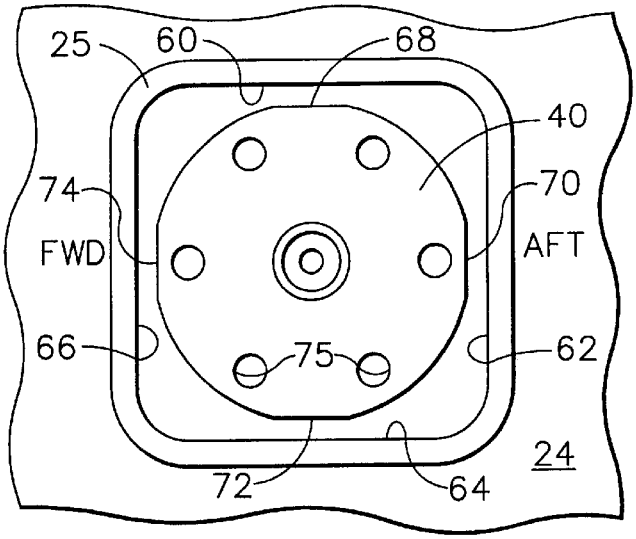
FIG. 3 is a sectional view taken along line A—A of FIG. 2 showing the relationship between the flange of the pilot fuel system and the boss formed on the combustor casing.

Referring now to FIG. 3, it is seen how boss 25 encircles flange 40 of pilot fuel assembly 34. Boss 25 forms a substantially rectangular shape having four flat surfaces, referred to herein as first boss surface 60, second boss surface 62, third boss surface 64 and fourth boss surface 66. Each of the boss surfaces 60–66 extends radially beyond and perpendicular to the outer surface of casing 24. Adjacent boss surfaces are perpendicular to each other, while opposite boss surfaces are parallel to one another. Preferably, parallel boss surfaces 60 and 64 are aligned so as to be parallel to the combustor casing's longitudinal axis, which means that boss surfaces 62 and 66 are tangential or perpendicular to the longitudinal axis, with boss surface 62 being disposed aft of boss surface 66.

The perimeter of mounting flange 40 defines an essentially circular shape but includes four flat surfaces, referred to herein as first flange surface 68, second flange surface 70, third flange surface 72 and fourth flange surface 74. Flange 40 also includes a number of bolt holes 75 that receive bolts 41 for fastening pilot fuel assembly 34 to casing 24. Similarly to the boss surfaces, adjacent flange surfaces are perpendicular to each other, while opposite flange surfaces are parallel to one another. Flange 40 is sized so that when it is located within boss 25, there is plenty of clearance between each of the boss surfaces 60–66 and the respective nearest one of the flange surfaces 68–74.

Referring now to FIGS. 4–9 a first embodiment of a method for concentrically installing pilot fuel assembly 34 in combustor casing 24 is illustrated. Pilot fuel assembly 34 is initially inserted into opening 36 so that cylindrical body 38 is located within swirler assembly 44, and flange 40 is located within boss 25. Pilot fuel assembly 34 is oriented so that each flange surface 68–74 is adjacent to, and substantially parallel to, a corresponding one of the boss surfaces 60–66. At this point, the relative position of cylindrical body 38 with respect to swirler assembly 44 is unknown. The next step is to move pilot fuel assembly 34 as far as it will go in a first direction substantially parallel to one of the boss surfaces 60–66. For the purposes of illustration, the first direction is the tangential direction toward boss surface 60 and parallel to boss surfaces 62 and 66; however, it should be noted that the first direction can be in any direction that is parallel to one of the boss surfaces.

Figure 4:
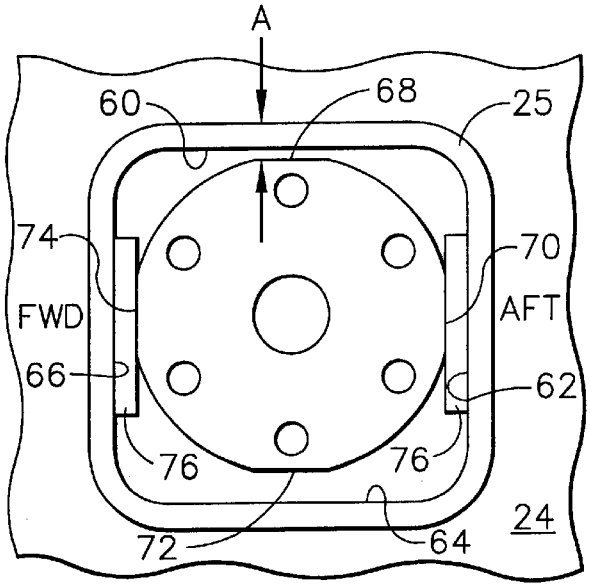
FIG. 4 is a sectional view taken along line A—A of FIG. 2 showing the relationship between the flange and the boss with the pilot fuel assembly moved to a first position.
Figure 5:
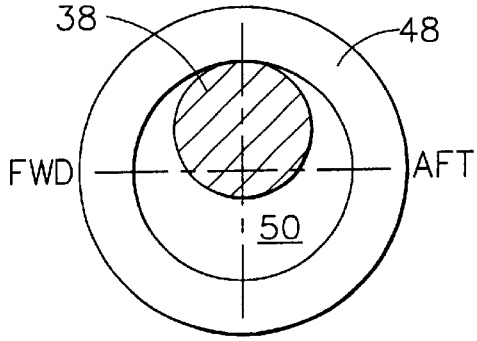
FIG. 5 is a sectional view taken along line B—B of FIG. 2 showing the relationship between the cylindrical body and the cap plate of the pilot fuel system with the pilot fuel assembly in the first position.

By moving pilot fuel assembly 34 as far as it will go in the first direction toward boss surface 60, cylindrical body 38 will come into contact with circular aperture 50 of cap plate 48, as shown in FIG. 5. Because of the circular configuration of aperture 50, forcing pilot fuel assembly 34 as far as it can go in the first direction will cause it to become centered in the axial direction; i.e., by seeking the farthest point in the tangential direction, pilot fuel assembly 34 will be centered between the forward-most and aft-most points of aperture 50. Next, a pair of guide bars 76 is used to maintain the axial position of pilot fuel assembly 34, as shown in FIG. 4. One of the guide bars 76 is disposed in the gap defined by boss surface 62 and flange surface 70, and the other guide bar 76 is disposed in the gap defined by boss surface 66 and flange surface 74. Guide bars 76 are preferably elongated hexahedral members having a width that matches the width of the gap in which they are disposed. In this way, pilot fuel assembly 34 is prevented from moving in either the fore or aft axial directions but allowed to move in either tangential direction by virtue of flange surfaces 70 and 74 sliding along their respective guide bar 76.

With pilot fuel assembly 34 still in the position shown in FIGS. 4 and 5 (i.e., as far as it will go in the first direction toward boss surface 60), a first measurement of the distance between boss surface 60 and flange surface 68 is taken (distance A in FIG. 4). Pilot fuel assembly 34 is then moved as far as it will go in a second direction, opposite to the first direction and toward boss surface 64. During this movement, flange surfaces 70 and 74 maintain sliding contact with their respective guide bars 76. It is noted that while it is preferred to use two guide bars 76, the method of the present invention can be carried out using only one guide bar 76, as long as the corresponding flange surface is maintained in contact with the single guide bar 76 while pilot fuel assembly 34 is moved in the second direction.

Figure 6:
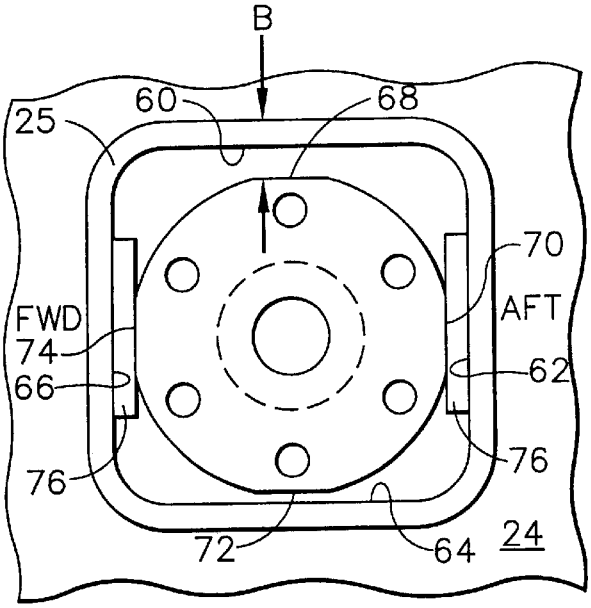
FIG. 6 is a sectional view taken along line A—A of FIG. 2 showing the relationship between the flange and the boss with the pilot fuel assembly moved to a second position.
Figure 7:
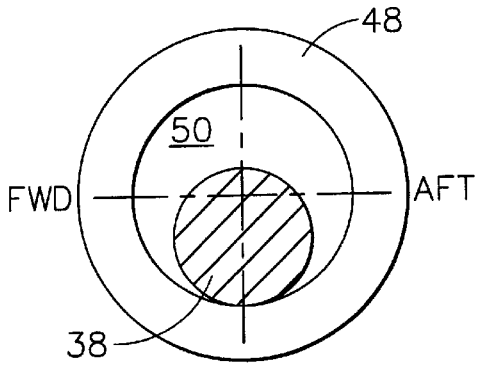
FIG. 7 is a sectional view taken along line B—B of FIG. 2 showing the relationship between the cylindrical body and the cap plate with the pilot fuel assembly in the second position.
Figure 8:
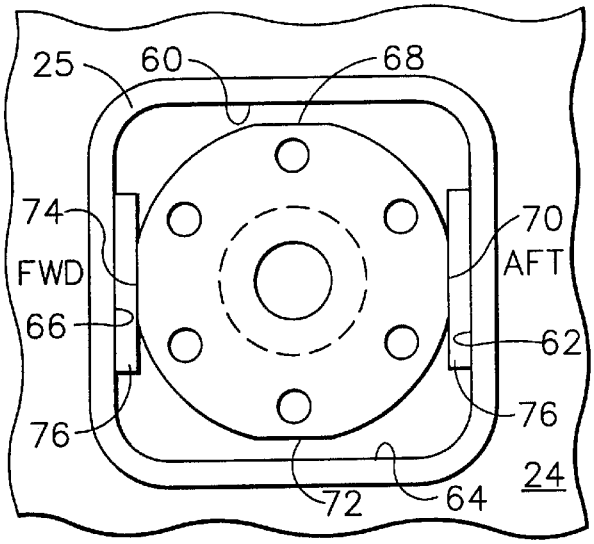
FIG. 8 is a sectional view taken along line A—A of FIG. 2 showing the relationship between the flange and the boss with the pilot fuel assembly moved to a centered position.
Figure 9:
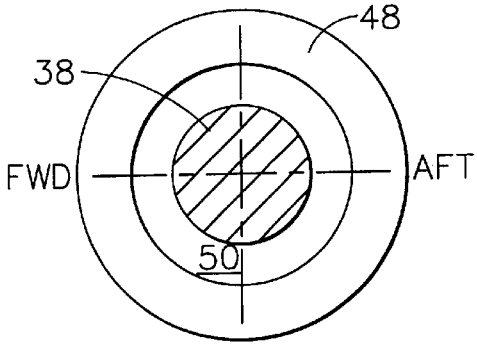
FIG. 9 is a sectional view taken along line B—B of FIG. 2 showing the relationship between the cylindrical body and the cap plate with the pilot fuel assembly in the centered position.
Figure 10:
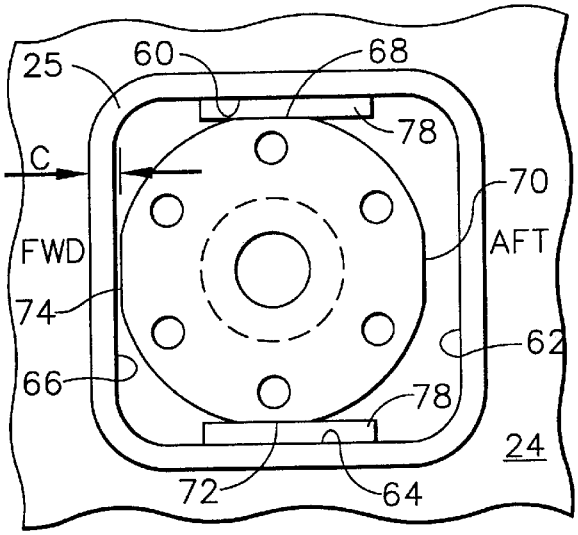
FIG. 10 is a sectional view taken along line A—A of FIG. 2 showing the relationship between the flange and the boss with the pilot fuel assembly moved to a third position.
Figure 11:
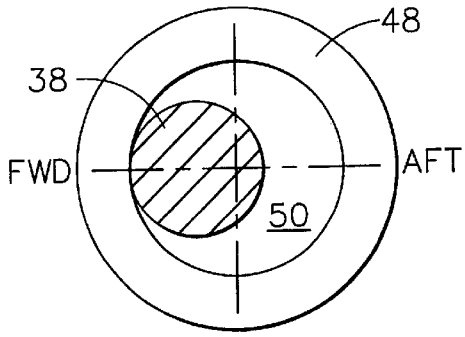
FIG. 11 is a sectional view taken along line B—B of FIG. 2 showing the relationship between the cylindrical body and the cap plate with the pilot fuel assembly in the third position.
Figure 12:
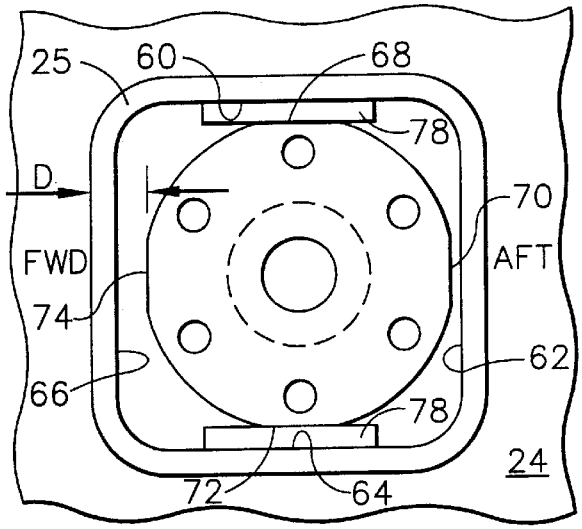
FIG. 12 is a sectional view taken along line A—A of FIG. 2 showing the relationship between the flange and the boss with the pilot fuel assembly moved to a fourth position.
Figure 13:
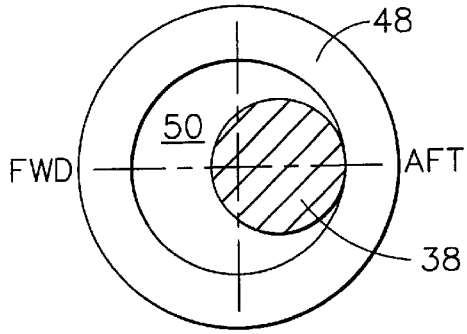
FIG. 13 is a sectional view taken along line B—B of FIG. 2 showing the relationship between the cylindrical body and the cap plate with the pilot fuel assembly in the fourth position.

The movement of pilot fuel assembly 34 as far as it will go in the second direction will place pilot fuel assembly 34 in the position shown in FIGS. 6 and 7, with cylindrical body 38 in contact with circular aperture 50 at a point opposite that of FIG. 5. A second measurement of the distance between boss surface 60 and flange surface 68 is taken at this position (distance B in FIG. 6). Next, the average of the first and second measurements is determined, and pilot fuel assembly 34 is moved back in the first direction toward boss surface 60 so as to be located at a position where the distance between boss surface 60 and flange surface 68 is equal to the average of the first and second measurements, as shown in FIGS. 8 and 9. Again, the movement of pilot fuel assembly 34 is done while maintaining sliding contact between flange surfaces 70 and 74 and their respective guide bars 76. Accordingly, pilot fuel assembly 34 is now centered in both the axial and tangential directions and concentricity between pilot fuel assembly 34 and swirler assembly 44 is achieved. Lastly, pilot fuel assembly 34 is fastened to casing 24 with bolts 41, and guide bars 76 are removed.

This method will provide concentricity between pilot fuel assembly 34 and swirler assembly 44 at cold assembly temperatures. During operation of the engine, these elements will be exposed to much higher temperatures and may thus move relative to one another due to differences in the amount of thermal expansion the elements will undergo. Thus, when centering pilot fuel assembly 34, it may be necessary to include an offset to the position determined by the average of the first and second measurements which will account for thermal expansion. The offset will ensure that pilot fuel assemblies 34 are concentric when the engine is at its steady state operating temperatures.

FIGS. 10–15 show an alternative embodiment of a method for concentrically installing pilot fuel assembly 34 in combustor casing 24. This alternative approach employs additional steps that are useful in the event that, while moving pilot fuel assembly 34 as far as it can go in the first tangential direction, the circular configuration of aperture 50 does not cause pilot fuel assembly 34 to become centered in the axial direction. In this case, pilot fuel assembly 34 is not fastened to casing 24 after being located at the position of FIGS. 8 and 9. Instead, additional steps are carried out to assure that pilot fuel assembly 34 is centered in the axial direction after it has been centered in the tangential direction. In this alternative method, pilot fuel assembly 34 is first centered in the tangential direction using the same steps described above in connection with the method of the first embodiment. Thus, a description of these steps will not be repeated here. As noted above, centering pilot fuel assembly 34 in the tangential direction first is only for purposes of illustration; it is equally within the scope of the present invention to first center pilot fuel assembly 34 in the axial direction. Moreover, it is not necessary to center pilot fuel assembly 34 in the tangential and axial directions. Centering can be accomplished along any two perpendicular axes.

Once pilot fuel assembly 34 has been centered in the tangential direction in the manner described above, additional guide bars 78 are provided and first guide bars 76 are removed. One of the guide bars 78 is disposed in the gap defined by boss surface 60 and flange surface 68, and the other guide bar 78 is disposed in the gap defined by boss surface 64 and flange surface 72. Guide bars 78 have a width that matches the width of the gap in which they are disposed so that pilot fuel assembly 34 is prevented from moving in either tangential direction but is allowed to move in either axial direction by virtue of flange surfaces 68 and 72 sliding along their respective guide bar 78.

Pilot fuel assembly 34 is now moved as far as it will go in a third direction, which is the forward axial direction toward boss surface 66 and parallel to boss surfaces 60 and 64. The third direction is also perpendicular to the first and second directions. During this movement, flange surfaces 68 and 72 maintain sliding contact with their respective guide bars 78. The movement of pilot fuel assembly 34 as far as it will go in the third direction will place pilot fuel assembly 34 in the position shown in FIGS. 10 and 11, with cylindrical body 38 in contact with circular aperture 50 at the most forward point. With pilot fuel assembly 34 in this position, a third measurement, this time of the distance between boss surface 66 and flange surface 74, is taken (distance C in FIG. 10).

Figure 14:
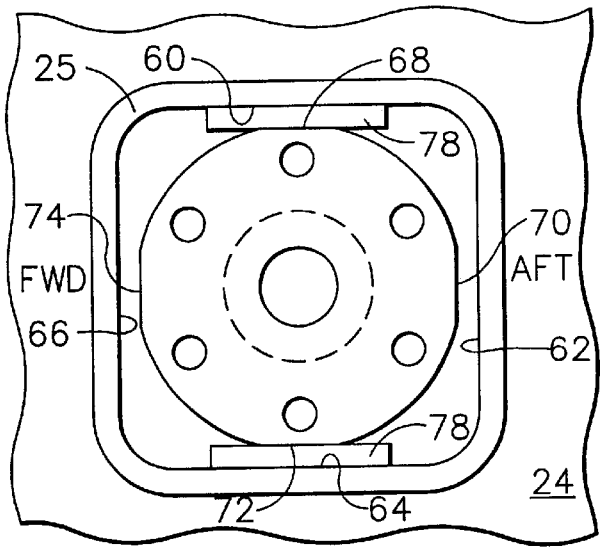
FIG. 14 is a sectional view taken along line A—A of FIG. 2 showing the relationship between the flange and the boss with the pilot fuel assembly moved to a centered position.
Figure 15:
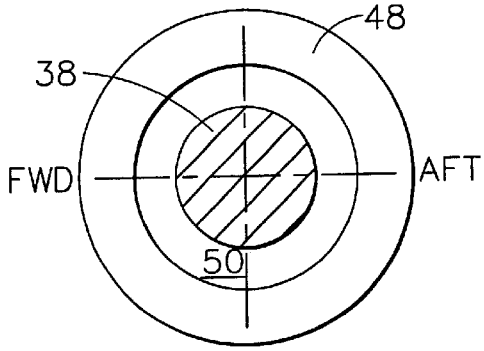
FIG. 15 is a sectional view taken along line B—B of FIG. 2 showing the relationship between the cylindrical body and the cap plate with the pilot fuel assembly in the centered position.

Pilot fuel assembly 34 is next moved as far as it will go in a fourth direction (the aft axial direction), opposite to the third direction and toward boss surface 62. During this movement, flange surfaces 68 and 72 maintain sliding contact with their respective guide bars 78. The movement of pilot fuel assembly 34 as far as it will go in the fourth direction will place pilot fuel assembly 34 in the position shown in FIGS. 12 and 13, with cylindrical body 38 in contact with circular aperture 50 at its most aft point. A fourth measurement of the distance between boss surface 66 and flange surface 74 is taken at this position (distance D in FIG. 12). Next, the average of the third and fourth measurements is determined, and pilot fuel assembly 34 is moved back in the third direction toward boss surface 66 so as to be located at a position where the distance between boss surface 66 and flange surface 74 is equal to the average of the third and fourth measurements, as shown in FIGS. 14 and 15. Again, the movement of pilot fuel assembly 34 is done while maintaining sliding contact between flange surfaces 68 and 72 and their respective guide bars 78. Accordingly, pilot fuel assembly 34 is now centered in both the axial and tangential directions and concentricity between pilot fuel assembly 34 and swirler assembly 44 is achieved. Lastly, pilot fuel assembly 34 is fastened to casing 24 with bolts 41, and guide bars 78 are removed.

Figure 16:
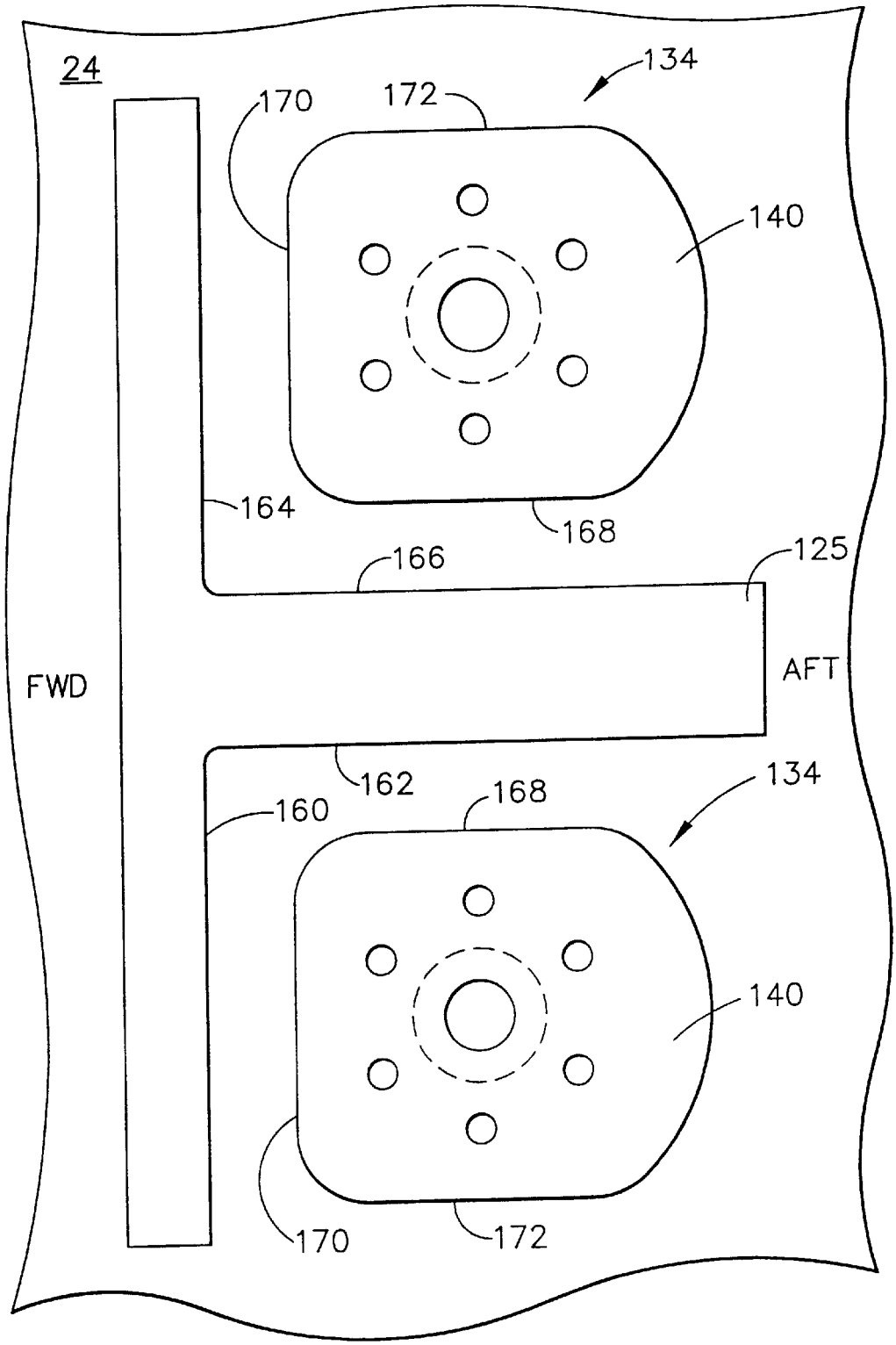
FIG. 16 is a partial top view of another embodiment of a combustor having adjacent pilot fuel assemblies sharing a common mounting flange.

Referring to FIG. 16, a second structural embodiment is shown. In this embodiment, adjacent, circumferentially spaced pilot fuel assemblies 134 are disposed in adjacent openings formed in casing 24. The mounting flange 140 of each pilot fuel assembly 134 is shown in FIG. 16. The perimeter of mounting flange 140 defines an essentially circular shape but includes three flat surfaces, referred to herein as first flange surface 168, second flange surface 170 and third flange surface 172. Adjacent flange surfaces are perpendicular to each other. A T-shaped boss 125 is formed on the outer surface of casing 24, with a wall thereof being located between the two flanges 140. Boss 125 has four flat surfaces: first boss surface 160 and second boss surface 162 facing a first one of the flanges 140, and third boss surface 164 and fourth boss surface 166 facing the other of the flanges 140. First boss surface 160 is perpendicular to second boss surface 162, and third boss surface 164 is perpendicular to fourth boss surface 166, while first boss surface 160 is parallel to third boss surface 164, and second boss surface 162 is parallel to fourth boss surface 166. Preferably, parallel boss surfaces 162 and 166 are aligned so as to be parallel to the combustor casing's longitudinal axis, which means that boss surfaces 160 and 164 are tangential or perpendicular to the longitudinal axis, although this alignment could be reversed.

The method for concentrically installing the pilot fuel assemblies 134 with this embodiment is similar to the method previously described. Each of the two pilot fuel assemblies 134 are installed using the same method, so only the method for the assembly 134 on the bottom as shown in FIG. 16 will be described. First, pilot fuel assembly 134 is moved as far as it will go in a first direction substantially parallel to one of the boss surfaces 160 or 162. For the purposes of illustration, the first direction is the axial direction toward boss surface 160 and parallel to boss surface 162; however, it should be noted that the first direction can be in any direction that is parallel to one of the boss surfaces. Next, a guide bar (not shown) is disposed between boss surface 162 and flange surface 168, and a first measurement of the distance between boss surface 160 and flange surface 170 is taken. Pilot fuel assembly 134 is then moved as far as it will go in a second direction, opposite to the first direction and away from boss surface 160. During this movement, flange surface 168 maintains sliding contact with the guide bar. At this point, a second measurement of the distance between boss surface 160 and flange surface 170 is taken. Next, the average of the first and second measurements is determined, and pilot fuel assembly 134 is moved back in the first direction toward boss surface 160 so as to be located at a position where the distance between boss surface 160 and flange surface 170 is equal to the average of the first and second measurements. Again, the movement of pilot fuel assembly 134 is done while maintaining sliding contact between flange surface 168 and the guide bar.

Pilot fuel assembly 134 is now centered in the axial direction, and if it is accepted that the circular configuration of the aperture in the swirler assembly causes pilot fuel assembly 134 to self-center in the tangential direction, then concentricity between pilot fuel assembly 134 and its corresponding swirler assembly is achieved. If not, then the process can be repeated in the tangential direction wherein pilot fuel assembly 134 is moved back-and-forth parallel to boss surface 160 and towards and away from boss surface 162 (using a guide bar between flange surface 170 and boss surface 160), with appropriate measurements being taken between flange surface 168 and boss surface 162. Now, pilot fuel assembly 134 is centered in both the axial and tangential directions, and concentricity between pilot fuel assembly 134 and its corresponding swirler assembly is achieved. It should be noted that only two of the flange surfaces (168, 170) are actually used in this process, and indeed the third flange surface 172 is not necessary to center pilot fuel assembly 134. However, the use of three flange surfaces avoids the need of having two different pilot fuel assemblies, one for the right side and one for the left side.

The foregoing has described a method for concentrically installing a pilot fuel system in a combustor and combustor structure on which the method can be performed. While specific embodiments of the present invention have been described, it will be apparent to those skilled in the art that various modifications thereto can be made without departing from the spirit and scope of the invention as defined in the appended claims.

What is claimed is:

1. A method for concentrically installing a pilot fuel assembly in a combustor casing, said method comprising the steps of:

providing first and second flat surfaces on said combustor casing, said first and second surfaces being perpendicular to one another;

providing third and fourth flat surfaces on said pilot fuel assembly, said third and fourth surfaces being perpendicular to one another;

inserting said pilot fuel assembly into an opening in said combustor casing;

moving said pilot fuel assembly as far as it will go in a first direction substantially parallel to said first surface;

taking a first measurement of the distance between said second and fourth surfaces;

moving said pilot fuel assembly as far as it will go in a second direction, opposite to said first direction;

taking a second measurement of the distance between said second and fourth surfaces; and locating said pilot fuel assembly at a position where the distance between said second and fourth surfaces is equal to the average of said first and second measurements.

2. The method of claim 1 further comprising the step of fastening said pilot fuel assembly to said combustor casing after said pilot fuel assembly has been located at a position where the distance between said second and fourth surfaces is equal to the average of said first and second measurements.

3. The method of claim 1 wherein the step of inserting said pilot fuel assembly into an opening includes orienting said pilot fuel assembly so that said first and third surfaces are substantially parallel to each other.

4. The method of claim 1 wherein said combustor casing has a longitudinal axis and said first surface is parallel to said axis.

5. The method of claim 1 wherein said combustor casing has a longitudinal axis and said first surface is perpendicular to said axis.

6. The method of claim 1 further comprising the step of placing a bar between said first and third surfaces and wherein said step of moving said pilot fuel assembly as far as it will go in a second direction includes maintaining said third surface in contact with said bar while moving said pilot fuel assembly.

7. The method of claim 1 further comprising the steps of:

providing fifth and sixth flat surfaces on said combustor casing, said fifth surface being parallel to said first surface and said sixth surface being parallel to said second surface;

providing seventh and eighth surfaces on said pilot fuel assembly, said seventh surface being parallel to said third surface and said eighth surface being parallel to said fourth surface;

placing a first bar between said first and third surfaces; and placing a second bar between said fifth and seventh surfaces;

wherein said step of moving said pilot fuel assembly as far as it will go in a second direction includes maintaining said third surface in contact with said first bar and said seventh surface in contact with said second bar while moving said pilot fuel assembly.

8. The method of claim 1 further comprising the steps of:

moving said pilot fuel assembly as far as it will go in a third direction perpendicular to said first and second directions;

taking a third measurement of the distance between said first and third surfaces;

moving said pilot fuel assembly as far as it will go in a fourth direction, opposite to said third direction;

taking a fourth measurement of the distance between said first and third surfaces; and locating said pilot fuel assembly at a position where the distance between said first and third surfaces is equal to the average of said third and fourth measurements.

9. The method of claim 8 further comprising the step of fastening said pilot fuel assembly to said combustor casing after said pilot fuel assembly has been located at a position where the distance between said first and third surfaces is equal to the average of said third and fourth measurements.

10. The method of claim 8 further comprising the step of placing a bar between said second and fourth surfaces.

11. The method of claim 10 wherein said step of moving said pilot fuel assembly as far as it will go in a third direction includes maintaining said fourth surface in contact with said bar while moving said pilot fuel assembly.

12. The method of claim 10 wherein said step of moving said pilot fuel assembly as far as it will go in a fourth direction includes maintaining said fourth surface in contact with said bar while moving said pilot fuel assembly.

13. The method of claim 8 further comprising the steps of:

providing fifth and sixth flat surfaces on said combustor casing, said fifth surface being parallel to said first surface and said sixth surface being parallel to said second surface;

providing seventh and eighth surfaces on said pilot fuel assembly, said seventh surface being parallel to said third surface and said eighth surface being parallel to said fourth surface;

placing a first bar between said second and fourth surfaces; and placing a second bar between said sixth and eighth surfaces.

14. The method of claim 13 wherein said step of moving said pilot fuel assembly as far as it will go in a third direction includes maintaining said fourth surface in contact with said first bar and said eighth surface in contact with said second bar while moving said pilot fuel assembly.

15. The method of claim 13 wherein said step of moving said pilot fuel assembly as far as it will go in a fourth direction includes maintaining said fourth surface in contact with said first bar and said eighth surface in contact with said second bar while moving said pilot fuel assembly.

* * * * *